US009287069B2

(12) United States Patent
Suzuki et al.

(10) Patent No.: US 9,287,069 B2
(45) Date of Patent: Mar. 15, 2016

(54) SWITCH STRUCTURE

(71) Applicant: Yazaki Corporation, Tokyo (JP)

(72) Inventors: Ken Suzuki, Makinohara (JP); Ryohei Konishi, Fujieda (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/560,284

(22) Filed: Dec. 4, 2014

(65) Prior Publication Data

US 2015/0179373 A1 Jun. 25, 2015

(30) Foreign Application Priority Data

Dec. 19, 2013 (JP) ..... 2013-262308

(51) Int. Cl.
*H01H 25/06* (2006.01)
*H01H 23/24* (2006.01)
*H01H 23/02* (2006.01)

(52) U.S. Cl.
CPC ..... *H01H 23/24* (2013.01); *H01H 23/025* (2013.01)

(58) Field of Classification Search
CPC ..... H01H 23/24; H01H 23/025; H01H 25/06; H01H 221/01; H01H 2221/036
USPC ..... 200/4, 6 R, 17 R, 520, 553, 282, 329, 200/339
See application file for complete search history.

(56) References Cited

U.S. PATENT DOCUMENTS 5,045,654 A * 9/1991 Pastwa ..... B60K 37/06 200/16 A
5,663,541 A * 9/1997 Mc Gregor, II ..... H01H 1/20 200/17 R
5,847,338 A * 12/1998 Kuki ..... H01H 3/02 200/16 E
2008/0302646 A1 12/2008 Nagai et al.

FOREIGN PATENT DOCUMENTS

JP 2008-091212 A 4/2008

* cited by examiner

*Primary Examiner* — Edwin A. Leon
(74) *Attorney, Agent, or Firm* — Locke Lord LLP

(57) ABSTRACT

The switch structure is configured to have a switch knob, a lens for transmitting the light of a bulb in the interior of a vehicle, a bus bar connected between the bulb side and the power source side (not shown), and a convex portion protruding toward the switch knob. A conductive element is formed to have a bulb-side abutment portion that abuts on a bulb-side bus bar and is connected thereto and a power source side abutment portion that abuts on a power source side bus bar and is connected thereto. When attached to an operating element, the conductive element is configured to be retractable in a push direction and to be rotatable in a rotational direction relative to the operating element and slidably contacts with the bus bar upon rotation of the switch knob.

4 Claims, 8 Drawing Sheets

SWITCH STRUCTURE

BACKGROUND

1. Technical Field

The present invention relates to a switch structure that switches between the ON position in which a pair of bus bars connected to the power source side and the device side, respectively, is rendered conducting and the OFF position in which conduction is blocked.

2. Related Art

A vehicle is conventionally provided with electrical equipment such as an interior lamp and various switch structures are proposed that turns on and turns off the interior lamp, for example (e.g., see JP 2008-91212 A).

A vehicle interior lamp disclosed in JP 2008-91212 A includes a switch knob, a switch lever pivotally supporting the switch knob, and a housing. The switch lever has a conductive contact that makes contact with a bus bar received in the housing when the switch knob is operated to pivot. The contact is biased toward the bus bar by a spring provided in a direction perpendicular to the direction in which the switch knob is operated, and the contact makes contact with the bus bar when they are opposed to each other and conduction is established.

SUMMARY

In a conventional switch structure disclosed in JP 2008-91212 A, however, an oxide layer is gradually formed on the surfaces of the contact and the bus bar and a region on which the oxide layer is formed have low conductivity so that conduction between the contact and the bus bar tends to be unstable in a long-term use.

In view of the foregoing problem, an object of the present invention is to provide a switch structure that can maintain stable conduction.

In order to solve the problem described above, a switch structure of the invention includes a pair of bus bars connected to a power source side and a device side, respectively, and a switch knob mounted pivotally between the ON position in which the pair of bus bars is rendered conducting and the OFF position in which conduction is blocked. The switch knob is configured to have an operating element to be pushed to switch between the ON position and the OFF position, a conductive element that is pressed against the pair of bus bars in a push direction in which the operating element is operated and provides conduction between the pair of bus bars by making contact with the pair of bus bars, and a biasing unit configured to support the conductive element while being biased toward the push direction. The conductive element is formed to have an abutment portion abutting on the pair of bus bars and an extension portion that is continuous with the abutment portion and extends to the inside of the operating element, where the conductive element is configured to be retractable in the push direction and to be rotatable in the pivoting direction of the operating element relative to the operating element and slidably contacts with the bus bars upon rotation of the switch knob.

According to the present invention, since the conductive element is configured to be rotatable in the pivoting direction of the operating element relative to the operating element, the operating element will pivot and the conductive element will rotate through an angle greater than the pivoting angle of the operating element in switching between the ON position and the OFF position, and thus a wider range in which the conductive element is in contact with the bus bar is achieved.

Additionally, since the conductive element is biased in the push direction and slidably contacts with the bus bar upon rotation of the switch knob, the oxide layer formed would be rubbed and could be removed each time the switch knob is switched between the ON position and the OFF position if an oxide layer is formed in a position where the abutment portion abuts on the bus bar. Thus, a wide range of the oxide layer can be removed and the stability of conduction can be maintained.

In the switch structure according to the invention, it is preferable that the bus bars or a housing for receiving the bus bars is provided with a convex portion protruding toward the conductive element and the abutment portion is provided with a ridge that moves over the convex portion in switching between the ON position and the OFF position.

In such a configuration, the bus bars or the housing for receiving the bus bars is provided with the convex portion protruding toward the conductive element so that the movement of the ridge over the convex portion increases the restoring force of the biasing unit in switching between the ON position and the OFF position. Thus, upon switching between the ON position and the OFF position, the pivoting movement of the operating element and the restoring force of the biasing unit can switch the rotational direction of the conductive element relative to the operating element more reliably.

In the switch structure according to the invention, it is preferable that the operating element is provided with a side wall along the push direction and a through hole penetrating the side wall and the extension portion is provided with an engagement lug projecting into the through hole, the conductive element being attached to the operating element by engagement of the engagement lug with the through hole.

In such a configuration, the conductive element is attached to the operating element by engaging the engagement lug of the extension portion with the through hole of the operating element so that disengagement of the conductive element from the operating element can be prevented if the conductive element rotates relative to the operating element.

In the switch structure of the invention as described above, a wider range in which the conductive element is in contact with the bus bar is achieved and the conductive element slidably contacts with the bus bar so that a wide range of the oxide layer formed on the conductive element and the bus bar can be removed each time the switch knob is operated, thereby maintaining the stability of conduction.

BRIEF DESCRIPTION OF DRAWINGS

FIG. 6A illustrates the OFF position and FIG. 6B illustrates the conductive element as it moves over a convex portion;

DETAILED DESCRIPTION

Figure 1:
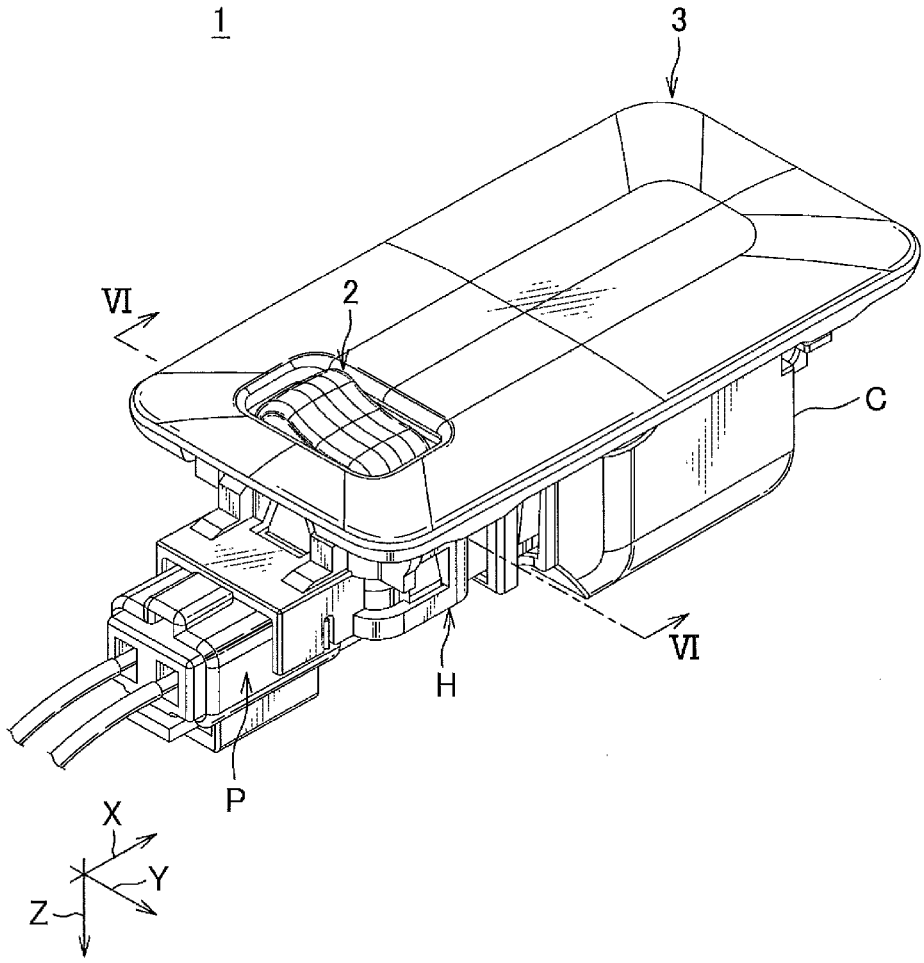
FIG. 1 is a perspective view of a switch structure according to an embodiment of the present invention.

An embodiment of the present invention will now be described with reference to FIGS. 1 to 8. A switch structure 1 of this embodiment is used as a switch structure that switches between the ON state and the OFF state of a bulb V connected to a power source side connector P that is assembled in a housing H, for example, for use in the interior lamp of a vehicle. As shown in FIG. 1, the switch structure 1 is configured to have a switch knob 2, a lens 3 for transmitting the light of the bulb V in the interior of a vehicle, and a bus bar 4 connected between a bulb V side and a power source side (not shown).

In the embodiment, the position of the switch knob 2 when the bus bar 4 is rendered conducting is defined as the ON position, and the position of the switch knob 2 when the conduction of the bus bar 4 is blocked is defined as the OFF position. The bulb V is turned on when the switch knob 2 is moved to the ON position, and the bulb V is turned off when the switch knob 2 is moved to the OFF position. In the embodiment, the longitudinal direction of the bus bar 4 is indicated by arrow X as shown in FIG. 1, defining a longitudinal direction X. The rotational direction of the switch knob 2 is indicated by arrow Y, defining a rotational direction Y. The back side and the front side of FIG. 1 are defined as one side and the other side, respectively, with regard to the rotational direction Y. A direction in which the switch knob 2 is pushed is indicated by arrow Z, defining a push direction Z. The vertical direction of arrow Z is based on FIG. 1.

The housing H, which is made of a resin material, holds the bus bar 4 and the bulb V when the switch structure 1 is assembled. The housing H is provided with a convex portion 5, which is located between a first bus bar 41 and a second bus bar 42 (described below) of the bus bar 4 and is formed protruding upward in the push direction Z relative to the upper surface of the first and second bus bars 41 and 42.

The lens 3, which is made of a resin material or the like that transmits light and has an opening along the push direction Z, includes an assembling portion 31 to which an operating element 21 (described below) of the switch knob 2 is assembled and a bearing groove 32 that is formed in the assembling portion 31 and holds a pivot shaft 214 (described below) of the operating element 21.

Figure 3:
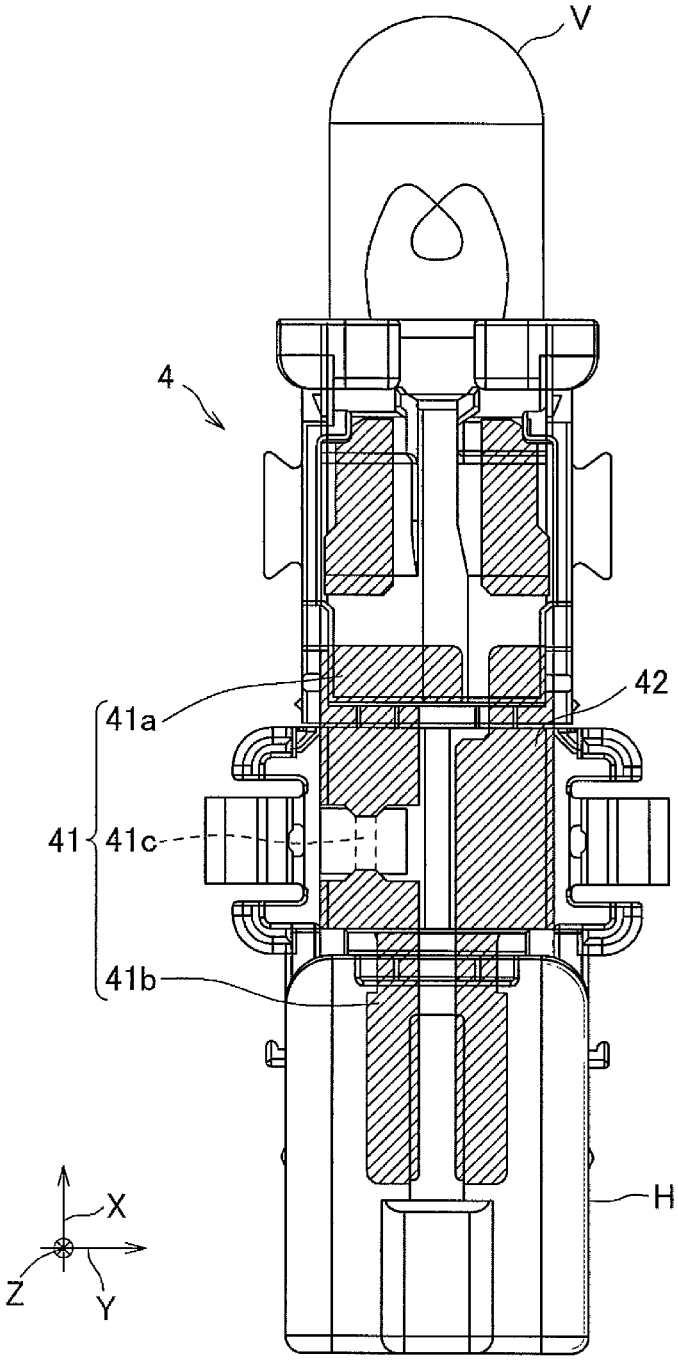
FIG. 3 is a plan view illustrating a bus bar of the switch structure taken along the line III-III of FIG. 2.

As shown in FIG. 3, the bus bar 4 is configured to have a first bus bar 41 that is received in the housing H and connects the negative side of a power supply (not shown) and the bulb V through the power source side connector P and a second bus bar 42 that connects the positive side of the power supply (not shown) and the bulb V through the power source side connector P. The first bus bar 41 includes a bulb-side bus bar 41*a* connected to a bulb-side conductive element 24 described below, a power source side bus bar 41*b* connected to a power source side conductive element 25 described below, and a connecting portion 41*c* for connecting the bulb-side bus bar 41*a* and the power source side bus bar 41*b*. After assembling of the first bus bar 41 to the housing H, the connecting portion 41*c* is disconnected from the bulb-side bus bar 41*a* and the power source side bus bar 41*b* and they are spaced from each other.

The switch knob 2 is configured to have an operating element 21 to be pushed to switch between the ON position and the OFF position, a conductive element 22 that is pressed against the bus bar 4 in the push direction Z and can make contact with the pair of bus bars 4, and a spring 23 that supports the conductive element 22 such that the conductive element 22 is retractable in the push direction Z relative to the operating element 21 and is biased toward the push direction Z.

Figure 2:
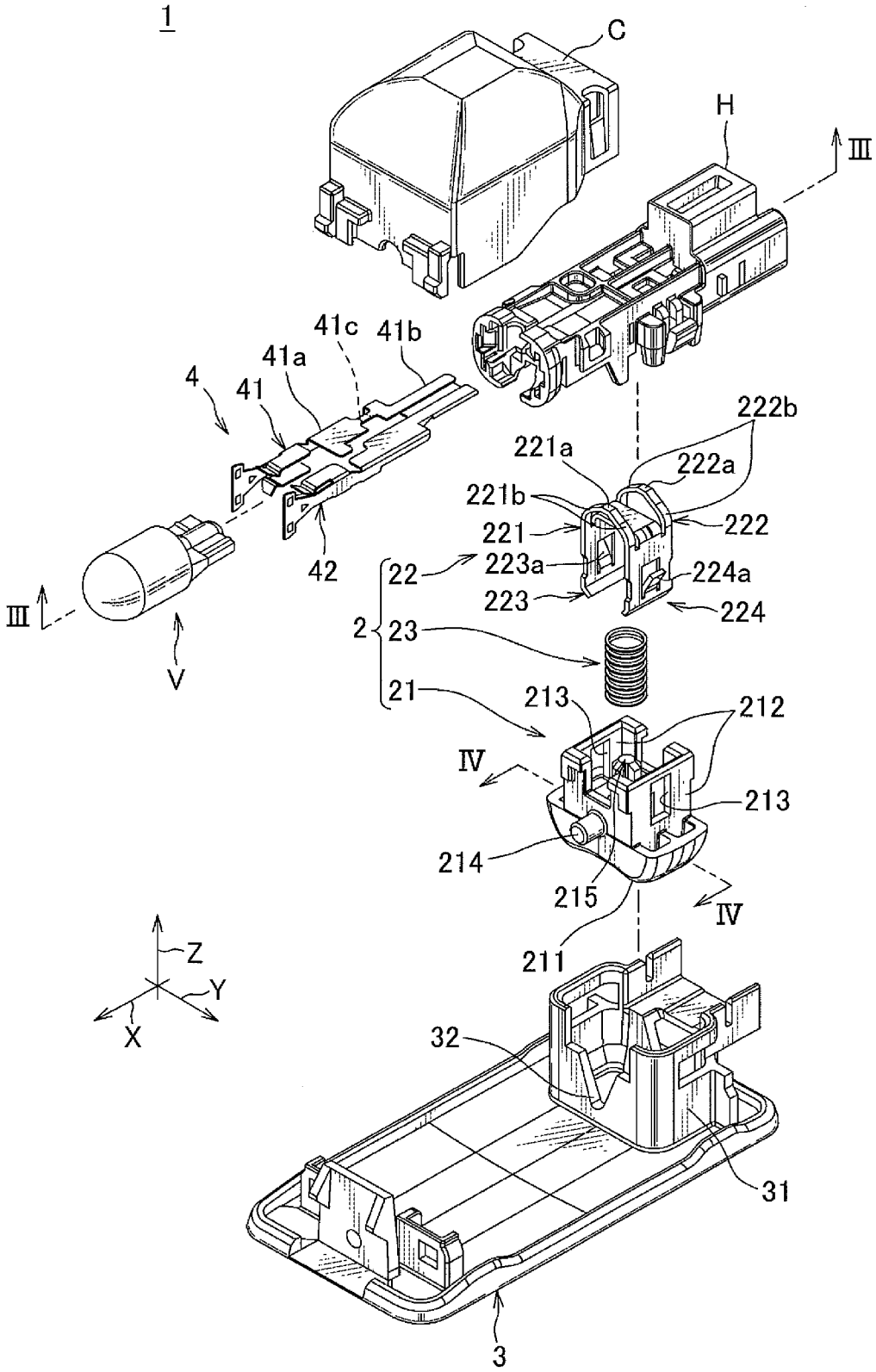
FIG. 2 is an exploded perspective view of the switch structure.

The operating element 21 is formed to have an operation surface 211 to be pushed, side walls 212 provided in a pair in the rotational direction Y and extending in the push direction Z, through holes 213 penetrating the side walls 212, a pivot shaft 214 for causing the operating element 21 to pivot in the rotational direction Y, and a spring support portion 215 for supporting the spring 23 so that the spring 23 contracts in the push direction Z. The conductive element 22 is attached to the operating element by engaging engagement lugs 223*a* and 224*a* of the conductive element 22 with the through holes 213. The through holes 213 are formed to be elongated in the push direction Z as shown in FIG. 2.

Figure 4A:
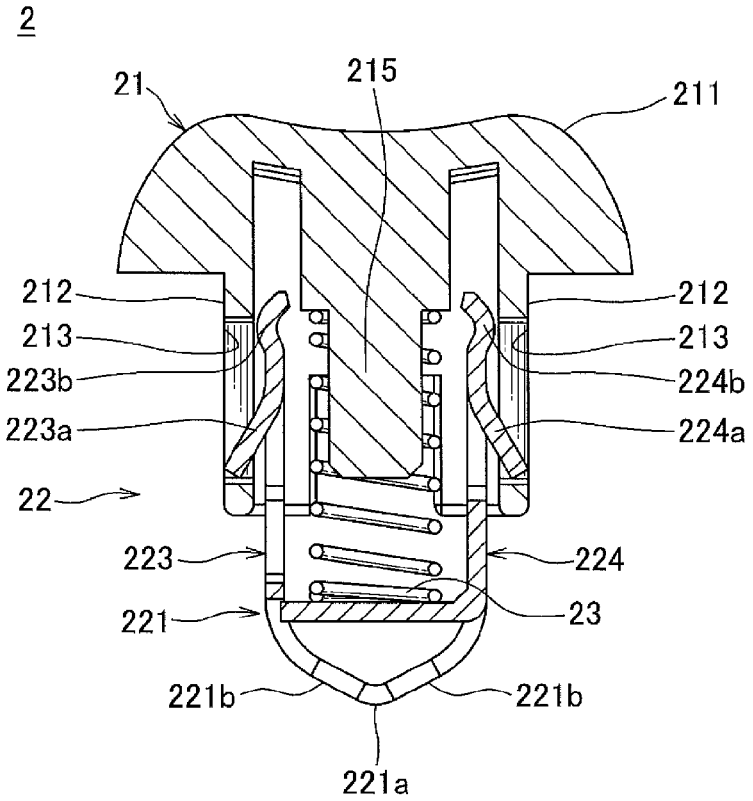
FIGS. 4A and 4B are sectional views of a switch knob of the switch structure taken along the line IV-IV of FIG. 2.
Figure 4B:
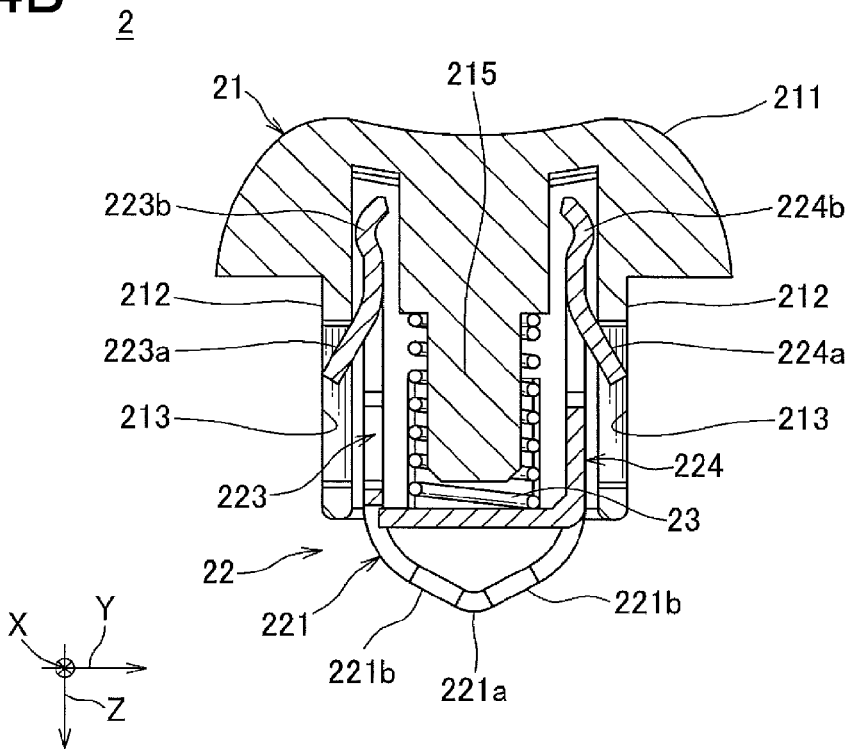

The conductive element 22 is formed to have a bulb-side abutment portion 221 that abuts on a bulb-side bus bar 41*a* and is connected thereto, a power source side abutment portion 222 that abuts on a power source side bus bar 41*b* and is connected thereto, and a one side extension portion 223 and the other side extension portion 224 that are provided continuously from the bulb-side abutment portion 221 and the power source side abutment portion 222 upward in the direction Z. The bulb-side abutment portion 221 and the power source side abutment portion 222 are arranged side by side along the longitudinal direction X. The one side extension portion 223 is located on one side of the rotational direction Y and the other side extension portion 224 is located on the other side of the rotational direction Y, the one side extension portion 223 and the other side extension portion 224 being opposed to each other in the rotational direction Y. As shown in FIGS. 4A and 4B, the conductive element 22 is configured to be retractable in the push direction Z relative to the operating element 21 when it is attached to the operating element 21.

The bulb-side abutment portion 221 includes a bulb-side ridge 221*a* protruding downward in the push direction Z, a pair of bulb-side inclined surfaces 221*b* that extend from the bulb-side ridge 221*a* in a direction away from each other along the rotational direction Y and upward in the push direction Z and are continuous with the one side extension portion 223 and the other side extension portion 224. The power source side abutment portion 222 includes a power source side ridge 222*a* protruding downward in the push direction Z, a pair of power source side inclined surfaces 222*b* that extend from the power source side ridge 222*a* in a direction away from each other along the rotational direction Y and upward in the push direction Z and are continuous with the one side extension portion 223 and the other side extension portion 224. When the switch knob 2 moves between the ON position and the OFF position, the lower surfaces in the push direction Z of the bulb-side ridge 221*a* and the power source side ridge 222*a* slidably contact with the bulb-side bus bar 41*a* and the power source side bus bar 41*b*, respectively, in the ON position and they slidably contact with the second bus bar 42 in the OFF position. The bulb-side ridge 221*a* and the power source side ridge 222*a* are configured to move over the convex portion 5 when the switch knob 2 is switched between the ON position and the OFF position.

Figure 5:
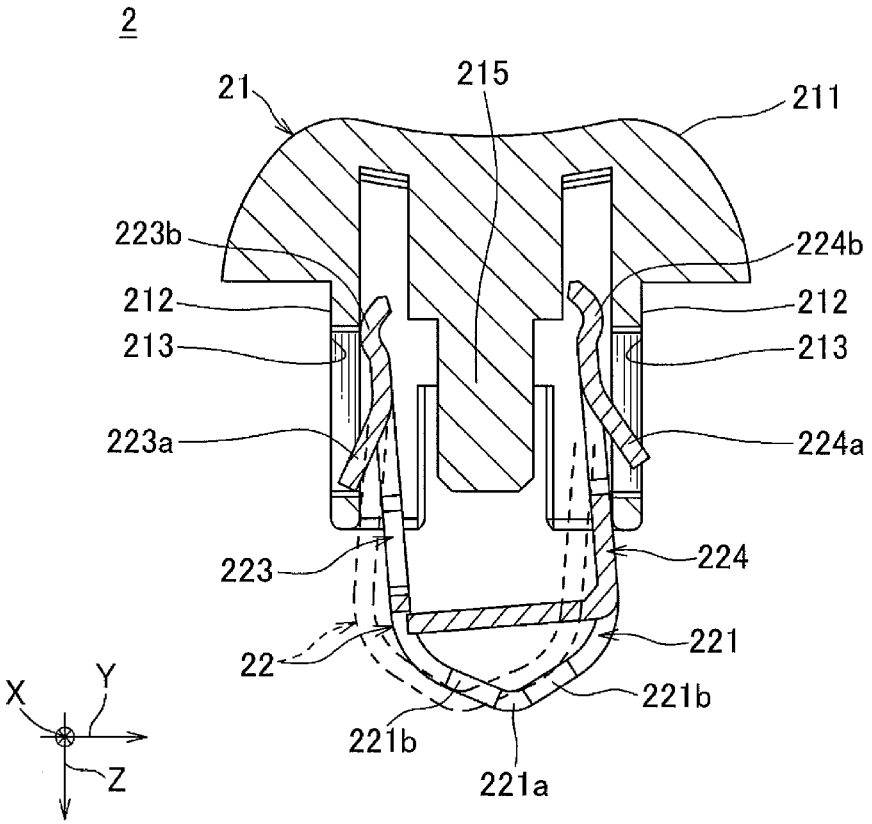
FIG. 5 is a sectional view illustrating the movement in the rotational direction of a conductive element.

The one side extension portion 223 and the other side extension portion 224 are provided therein with the engagement lugs 223*a* and 224*a*, respectively, that are cut upward in the push direction Z and are bent so as to open outward in the opposite direction of the one side extension portion 223 and the other side extension portion 224. The upper ends of the one side extension portion 223 and the other side extension portion 224 are provided with curved portions 223*b* and 224*b*, respectively, that are curved convexly outward in the opposite direction of the one side extension portion 223 and the other side extension portion 224. When the conductive element 22 is attached to the operating element 21, the engagement lugs 223*a* and 224*a* are inserted into the through holes 213 of the operating element 21 and the curved portions 223*b* and 224*b* can make contact with the inner surface of the side walls 212 of the operating element 21, as shown in FIG. 5. As shown in FIGS. 4 and 5, the distance between the outer surfaces of the one side extension portion 223 and the other side extension portion 224 is shorter than the distance between the inner surfaces of the pair of side walls 212 provided in the rotational direction Y of the operating element 21 so that the conductive element 22 can rotate in the rotational direction Y relative to the operating element 21.

An exemplary method of assembling the switch structure 1 will now be described with reference to FIGS. 1 and 2. First the spring 23 is inserted into the spring support portion 215 of the operating element 21 of the switch knob 2, the engagement lugs 223*a*, 224*a* of the conductive element 22 are inserted into and engaged with the through holes 213 of the operating element 21, whereby the conductive element 22 is attached to the operating element 21. Then the switch knob 2 is inserted into the assembling portion 31 of the lens 3 and the pivot shaft 214 of the operating element 21 is fitted to the bearing groove 32 of the lens 3. Thus, the switch knob 2 is rotatably supported. Subsequently, the first and second bus bars 41 and 42 are assembled from the bulb-side end of the housing H (i.e., from the left front side in FIG. 2) and the connecting portion 41*c* of the first bus bar 41 is disconnected. The bulb V is assembled to the bulb-side end of the housing H to which the bus bar 4 is attached. Such a housing H is fitted to the lens 3 to which the switch knob 2 is attached, a cover C is attached from the housing H side, and the power source side connector P connected to the power supply (not shown) is connected to the power source side end of the housing H (i.e., to the far right in FIG. 2). Thus, assembling is completed as shown in FIG. 1.

Figure 6A:
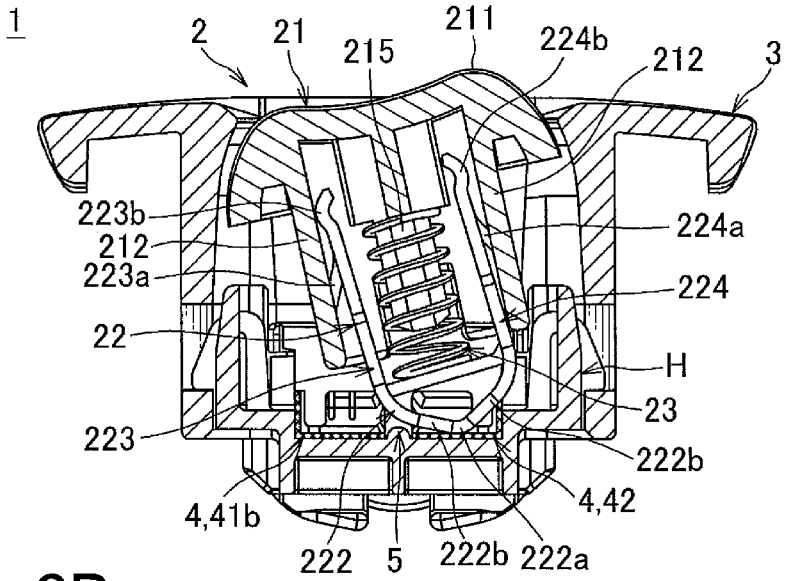
FIGS. 6A and 6B illustrate the movement of the switch structure taken along the line VI-VI of FIG. 1, where

The switch knob 2 and the bus bar 4 in the OFF position and the ON position of the switch knob 2 will now be described with reference to FIGS. 6 and 7. In the OFF position, as shown in FIG. 6A, the operating element 21 and the conductive element 22 rotates to the other side of the rotational direction Y, the bulb-side ridge 221*a* and the power source side ridge 222*a* abuts on the second bus bar 42, and the bulb-side bus bar 41*a* and the power source side bus bar 41*b* of the first bus bar 41 are spaced from each other, whereby conduction is blocked. In the ON position, as shown in FIG. 7C, the operating element 21 and the conductive element 22 rotates to the one side of the rotational direction Y, the bulb-side ridge 221*a* abuts on the bulb-side bus bar 41*a*, and the power source side ridge 222*a* abuts on the power source side bus bar 41*b*, whereby conduction is established through the bulb-side bus bar 41*a* and the power source side bus bar 41*b*.

In the following, the operation of the switch knob 2 when it is switched between the OFF position and the ON position is described. FIGS. 6A and 6B and FIGS. 7A to 7C illustrate the operation of the switch knob 2 when it is switched from the OFF position to the ON position, where the switch knob 2 is operated in the order as shown in FIG. 6A, in the view of which the switch knob 2 rotates the most to the other side of the rotational direction Y, FIG. 6B, FIG. 7A, FIG. 7B, and FIG. 7C, in the view of which the switch knob 2 rotates the most to the one side of the rotational direction Y. When the switch knob 2 is switched from the OFF position to the ON position, the operation surface 211 is pushed in the other side of the rotational direction Y, the operating element 21 of the switch knob 2 pivots to the one side of the rotational direction Y, and the conductive element 22 rotates to the one side of the rotational direction Y upon pivoting of the operating element 21. When the switch knob 2 is switched from the ON position to the OFF position, the operation surface 211 is pushed in the one side of the rotational direction Y, the operating element 21 of the switch knob 2 pivots to the other side of the rotational direction Y, and the conductive element 22 rotates to the other side of the rotational direction Y upon pivoting of the operating element 21.

The rotation of the conductive element 22 upon pivoting of the operating element 21 causes the bulb-side ridge 221*a* of the conductive element 22 to make a sliding contact with the bulb-side bus bar 41*a* and the power source side ridge 222*a* to make a sliding contact with the power source side bus bar 41*b* in the ON position and causes the bulb-side ridge 221*a* and the power source side ridge 222*a* to make a sliding contact with the second bus bar 42 in the OFF position.

Figure 8:
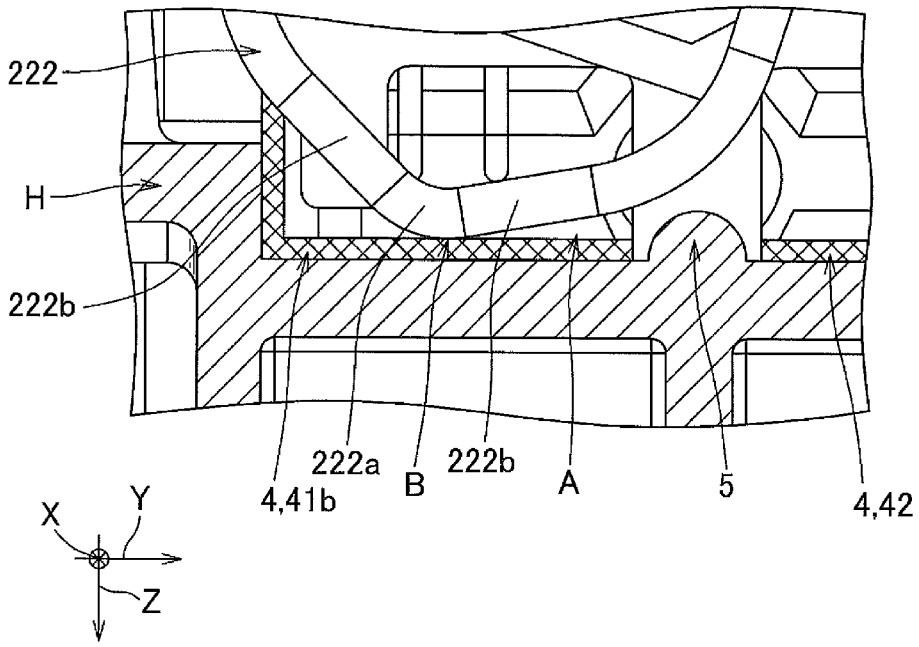
FIG. 8 is an enlarged view illustrating part of the switch structure in the ON position.

FIG. 8 shows the range in which the power source side ridge 222*a* is in sliding contact with the power source side bus bar 41*b* in the ON position. The power source side ridge 222*a* is in sliding contact with the power source side bus bar 41*b* in the range from a point (i.e., point A shown in FIG. 8) at which the power source side ridge 222*a* moves over the convex portion 5 to abut on the power source side bus bar 41*b* to a point (i.e., point B shown in FIG. 8) at which the power source side ridge 222*a* abuts on the power source side bus bar 41*b* when the conductive element 22 rotates the most to the one side of the rotational direction Y.

Figure 6B:
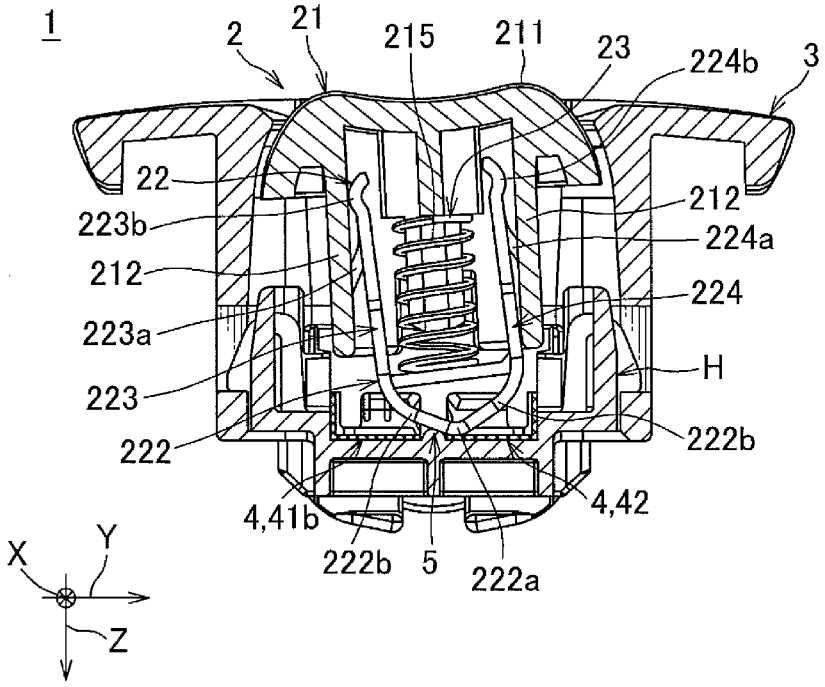
Figure 7A:
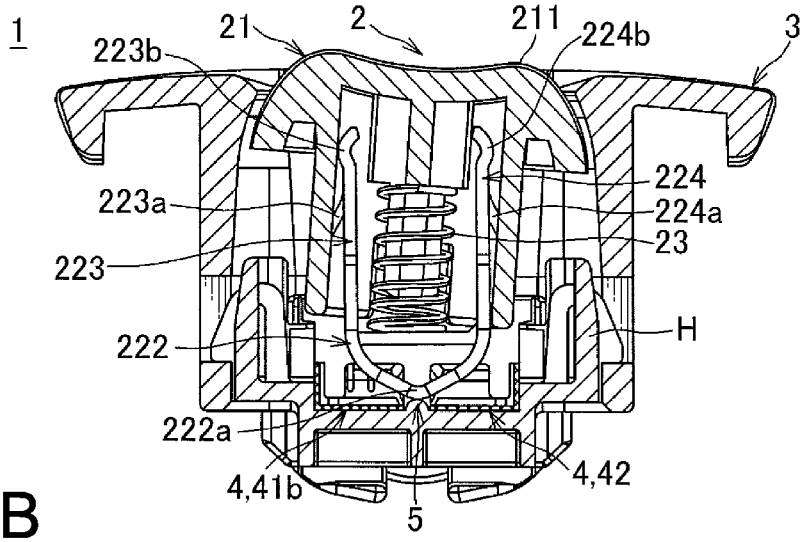
FIGS. 7A to 7C illustrate movements when the conductive element moves over the convex portion to switch to the ON position in the switch structure taken along the line VI-VI of FIG. 1.

When the bulb-side ridge 221*a* and the power source side ridge 222*a* move over the convex portion 5 in the switching process between the OFF position and the ON position, the conductive element 22 moves toward the operating element 21 to cause the spring 23 to contract as shown in FIGS. 6B and 7A so that the biasing force of the spring 23 is increased and the bulb-side ridge 221*a* and the power source side ridge 222*a* make a strong sliding contact with the bulb-side bus bar 41*a* and the power source side bus bar 41*b* or the second bus bar 42.

Figure 7B:
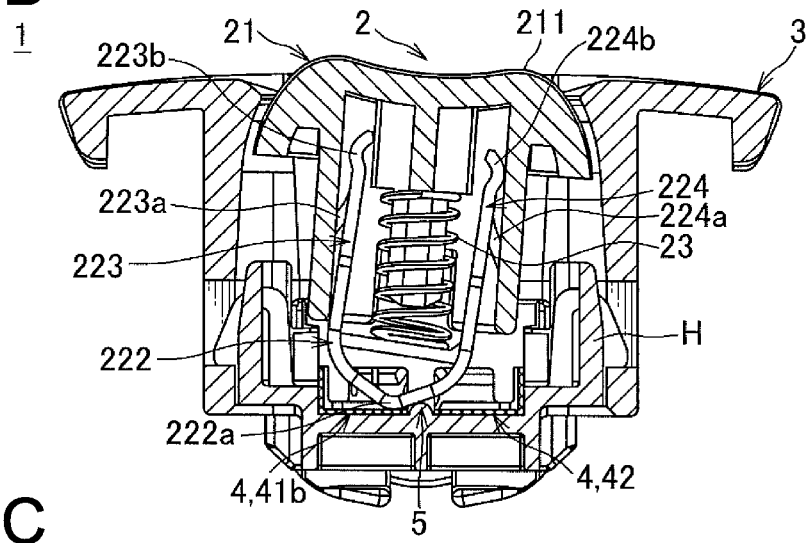
Figure 7C:
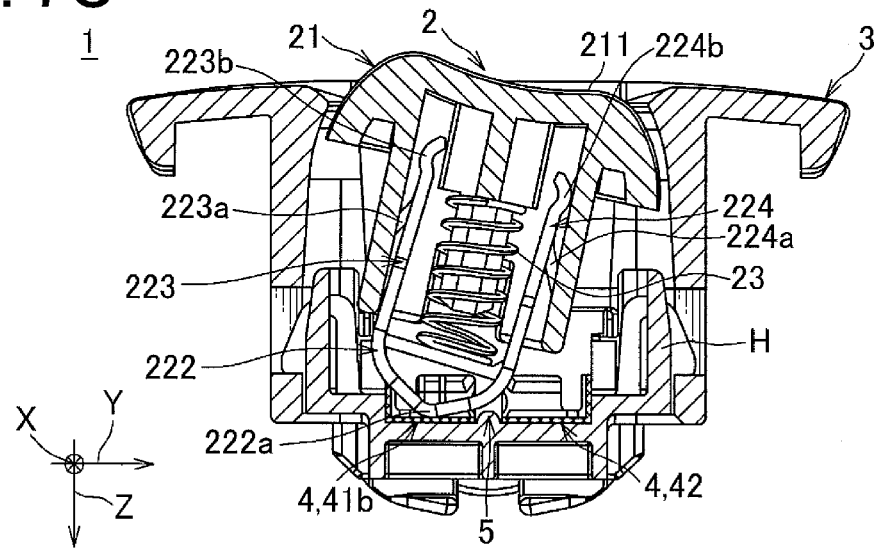

The rotating movement of the conductive element 22 relative to the operating element 21 will now be described. Until the bulb-side ridge 221*a* and the power source side ridge 222*a* of the conductive element 22 move over the convex portion 5 from the OFF position as shown in FIGS. 6A and 6B, the conductive element 22 is rotated on the other side of the rotational direction Y relative to the operating element 21 and the curved portion 223*b* of the one side extension portion 223 and the lower end of the other side extension portion 224 are in contact with the inner surfaces of the side walls 212 of the operating element 21. When the switch knob 2 further rotates toward the one side of the rotational direction Y and the bulb-side ridge 221*a* and the power source side ridge 222*a* move over the convex portion 5 as shown in FIGS. 7A to 7B, the restoring force of the spring 23 and the pivoting movement of the operating element 21 to the one side of the rotational direction Y causes the conductive element 22 to rotate to the one side of the rotational direction Y relative to the operating element 21, and the lower end of the one side extension portion 223 and the curved portion 224*b* of the other side extension portion 224 make contact with the inner surfaces of the side walls 212 of the operating element 21. Upon switching from the ON position to the OFF position, the conductive element 22 rotates to the other side of the rotational direction Y relative to the operating element 21 when the bulb-side ridge 221*a* and the power source side ridge 222*a* move over the convex portion 5. As described above, the conductive element 22 rotates in the rotational direction Y relative to the operating element 21 so that the rotating angle of the conductive element 22 is greater than the pivoting angle of the operating element 21.

Since the conductive element 22 is configured to be rotatable in the rotational direction Y relative to the operating element 21 according to the embodiment described above, the conductive element 22 rotates through an angle greater than the pivoting angle of the operating element 21 in switching between the ON position and the OFF position, and thus a wider range in which the bulb-side ridge 221*a* and the power source side ridge 222*a* of the conductive element 22 are in contact with the bus bar 4 is achieved. Additionally, since the conductive element 22 is biased in the push direction Z by the spring 23 and slidably contacts with the bus bar 4 upon rotation of the switch knob 2, the oxide layer formed would be rubbed and could be removed each time the switch knob 2 is switched between the ON position and the OFF position if an oxide layer is formed in a position where the bulb-side ridge 221*a* and the power source side ridge 222*a* of the conductive element 22 abut on the bus bar 4. Thus, the oxide layer formed on the bulb-side abutment portion 221, the power source side abutment portion 222, and the bus bar 4 can be widely removed each time the switch knob 2 is operated and the stability of conduction can be maintained.

Further, since the housing H is provided with the convex portion 5 protruding toward the conductive element 22, the movement of the bulb-side ridge 221*a* and the power source side ridge 222*a* over the convex portion 5 increases the restoring force of the spring 23 when the switch knob 2 is switched between the ON position and the OFF position. Thus, upon switching between the ON position and the OFF position, the pivoting movement of the operating element 21 and the restoring force of the spring 23 can switch the rotational direction of the conductive element 22 relative to the operating element 21 more reliably.

Still further, the conductive element 22 is attached to the operating element 21 by engaging the engagement lugs 223*a* and 224*a* of the conductive element 22 with the through holes 213 of the operating element 21 so that disengagement of the conductive element 22 from the operating element 21 can be prevented if the conductive element 22 rotates relative to the operating element 21.

The present invention is not limited to the embodiment described above, but rather includes other configurations by which an object of the present invention can be achieved, i.e., includes modifications such as the following.

While the switch structure 1 is used for vehicle interior lamp, for example, in the above embodiment, it may be used as a switch structure for switching other electrical equipment between the ON state and the OFF state.

Although the conductive element 22 is biased by the spring 23, the conductive element 22 may be biased by a biasing unit other than the spring 23.

Although the convex portion 5 is integrally formed with the housing H, it is only necessary that the approaching of the conductive element 22 to the operating element 21 causes the spring 23 to contract when the switch knob 2 is switched between the ON position and the OFF position, and the convex portion 5 can be integrally formed with the bus bar 4 accordingly.

The best configuration, method, and the like for carrying out the invention are disclosed above, but the invention is not limited thereto. That is, although the invention is illustrated and described mainly with reference to the specific embodiment, it is to be understood that variations in shapes, materials, quantities, and other detailed configurations can be made in the above-described embodiments by those skilled in the art without departing from the spirit and scope of the invention.

Accordingly, the exemplary description that specifies shapes and materials disclosed above is to facilitate the understanding of the invention and is not intended to limit the scope of the invention. The description using the names of components from which some of or all of the limitations on the shapes, materials, etc. are removed is intended to be included within the scope of the invention.

REFERENCE SIGNS LIST

1 switch structure
2 switch knob
3 lens
4 bus bar
5 convex portion
21 operating element
22 conductive element
23 spring (biasing unit)
212 side wall
213 through hole
221 bulb-side abutment portion (abutment portion)
222 power source side abutment portion (abutment portion)
223 one side extension portion (extension portion)
224 the other side extension portion (extension portion)
221*a* bulb-side ridge (ridge)
222*a* power source side ridge (ridge)
223*a*, 224*a* engagement lug

What is claimed is:

1. A switch structure comprising:

a pair of bus bars connected to a power source side and a device side, respectively, and a switch knob rotatably mounted between an ON position in which the pair of bus bars is rendered conducting and an OFF position in which conduction is blocked, wherein the switch knob is configured to have an operating element to be pushed to switch between the ON position and the OFF position, a conductive element that is pressed against the pair of bus bars in a push direction in which the operating element is operated and provides conduction between the pair of bus bars by making contact with the pair of bus bars, and a biasing unit configured to support the conductive element while being biased toward the push direction, and wherein the conductive element is formed to have an abutment portion abutting on the pair of bus bars and an extension portion that is continuous with the abutment portion and extends inside the operating element, and the conductive element is configured to be retractable in the push direction and to be rotatable in a pivoting direction of the operating element relative to the operating element and slidably contacts with the bus bars upon rotation of the switch knob.

2. The switch structure according to claim 1, wherein the bus bars or a housing for receiving the bus bars is provided with a convex portion protruding toward the conductive element, and wherein the abutment portion is provided with a ridge that moves over the convex portion in switching between the ON position and the OFF position.

3. The switch structure according to claim 1, wherein the operating element is provided with a side wall along the push direction and a through hole penetrating the side wall, wherein the extension portion is provided with an engagement lug projecting into the through hole, and wherein the conductive element is attached to the operating element by engagement of the engagement lug with the through hole.

4. The switch structure according to claim 2, wherein the operating element is provided with a side wall along the push direction and a through hole penetrating the side wall, wherein the extension portion is provided with an engagement lug projecting into the through hole, and wherein the conductive element is attached to the operating element by engagement of the engagement lug with the through hole.

* * * * *